350-345 SR
8/18/81 XR 4,285,029

United States Patent [19]

McCoy

[11] 4,285,029

[45] Aug. 18, 1981

[54] SELF-LUMINOUS LIGHTING SYSTEM

[75] Inventor: Marshall W. McCoy, Tucson, Ariz.

[73] Assignee: American Atomics Corporation, Tucson, Ariz.

[21] Appl. No.: 31,075

[22] Filed: Apr. 18, 1979

[51] Int. Cl.[3] ..... F21V 9/16

[52] U.S. Cl. ..... 362/84; 362/263; 350/345

[58] Field of Search ..... 362/84, 263, 31, 32; 350/345

[56] References Cited

U.S. PATENT DOCUMENTS

| | | | |
|---|---|---|---|
| 2,028,241 | 1/1936 | Paul | 362/84 |
| 4,096,550 | 6/1978 | Boller | 362/31 |
| 4,104,627 | 8/1978 | Thuler | 350/345 |
| 4,126,384 | 11/1978 | Goodman | 350/345 |

*Primary Examiner*—Donald P. Walsh
*Attorney, Agent, or Firm*—Christie, Parker & Hale

[57] ABSTRACT

An elongated light-diffusive body having a trapezoidal cross-section encapsulates an axially elongated self-luminous light source. The body has a wide base, a narrow base, and slanted sides between the bases. Opening to its narrow base, the body has a longitudinal slot in which the light source fits. A substantially total reflector extends around the slanted sides and the narrow base, including the exposed portion of the light source, to reflect all the light toward the wide base. Distribution of the light emitted from the tube is changed as it leaves the wide base by a partially transmissive coating on the portion of the wide base through which light rays from the tube pass normal to the wide base.

16 Claims, 4 Drawing Figures

SELF-LUMINOUS LIGHTING SYSTEM

BACKGROUND OF THE INVENTION

This invention relates to the control of light distribution and direction and, more particularly, to a lighting system that utilizes a self-luminous light source.

One type of self-luminous light source in use today comprises an axially elongated glass tube sealed at its ends, phosphor coated on its inner surface, and filled with a radioactive gas, such as tritium. When beta emission from the gas strikes the phosphor coating, visible light is emitted from the tube. Miniature self-luminous light sources of the described type are commonly used to backlight liquid crystal displays in digital watches and other electronic instruments with visual displays. In contrast to incandescent lamps, such a self-luminous light source requires no electrical power source, illuminates the liquid crystal display in the absence of ambient light without a switching operation, and provides many years of maintenance-free operation.

The common practice is to mount one or more miniature light sources, depending upon the area of the liquid crystal display to be illuminated, in a shallow pan having a light-reflective surface. The pan, which is located adjacent to the back face of the liquid crystal display, serves to hold the light source in place and reflect all the light emitted therefrom through the liquid crystal display. For digital watch applications in particular, the cross-section of the glass tube is elongated. The wider and thinner the cross-section of the glass tube, the more area of the liquid crystal display can be illuminated without increasing the thickness of the liquid crystal display-light source assembly. If the area of the liquid crystal display to be illuminated is wider than the light source to be used, the current practice is to use a plurality of light sources so the resultant area of the light sources coincides with or exceeds the area of the liquid crystal display to be illuminated.

SUMMARY OF THE INVENTION

According to the invention, an elongated light-diffusive body encapsulates an axially elongated, self-luminous light source. One portion of the side surface of the body forms a front face wider than the light source. A substantially total reflector extends around the entire side surface of the body, except for the front face, to reflect all the light emitted from the tube toward the front face. The distribution of the light emitted from the tube is changed as it leaves the front face of the body, specifically to distribute such light approximately evenly across the front face.

In the preferred embodiment, the light-diffusive body has a trapezoidal cross-section; its wide base comprises a flat front face, and its narrow base and slanted sides comprise the remainder of the side surface of the body. Opening to its narrow base, the body has a longitudinal slot into which the light source fits. The light distribution is changed by a partially transmissive coating on the portion of the front face through which light rays from the tube pass normal to the front face. When the described lighting system is used to backlight a liquid crystal display, the front face of the body is adjacent to the back face of the liquid crystal display and coincides in area with the figure display region thereof.

BRIEF DESCRIPTION OF THE DRAWINGS

The features of specific embodiments of the best mode contemplated of carrying out the invention are illustrated in the drawings, in which.

DETAILED DESCRIPTION OF THE SPECIFIC EMBODIMENTS

Figure 1:
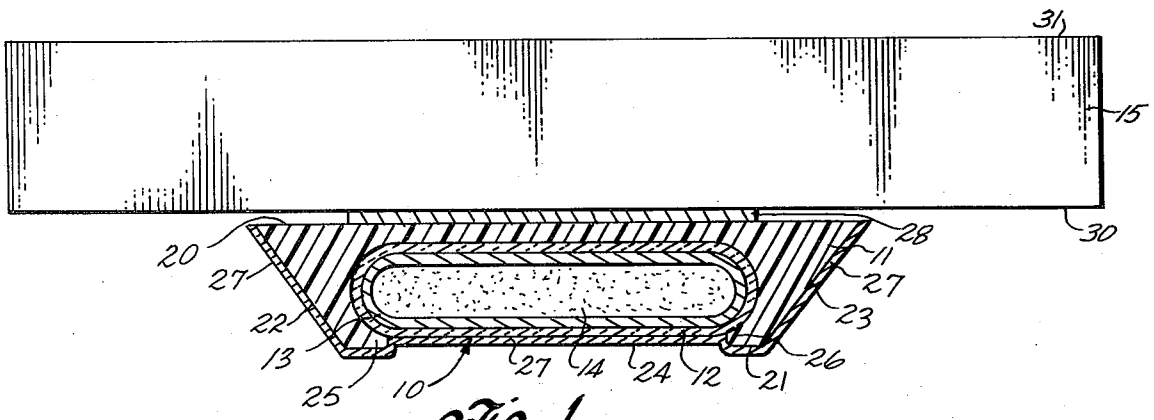
FIG. 1 is a side-sectional view of a lighting system incorporating the principles of the invention.
Figure 2:
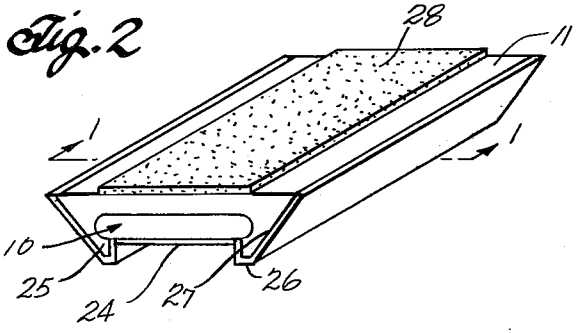
FIG. 2 is a perspective view of the lighting system of FIG. 1.

In FIGS. 1 and 2, a self-luminous lighting system includes an axially elongated self-luminous light source 10 encapsulated in an elongated light-diffusive body 11 having a trapezoidal cross-section. Light source 10 comprises an axially elongated glass tube 12 having laser-sealed ends, not shown. As depicted in FIG. 1, the cross-section of tube 12 is also elongated to provide a wide light-emitting surface without increasing thickness. The inside surface of tube 12 has a phosphor coating 13. Tube 12 contains tritium gas, designated 14, usually at superatmospheric pressure. Beta radiation from the tritium gas in tube 12 strikes coating 13 to emit visible light used to illuminate a liquid crystal display 15. Preferably, the narrow side faces of tube 12 are thicker than the wide side faces as described in copending application, Ser. No. 916,876, filed June 19, 1978, by Thomas E. Caffarella et al and assigned to the assignee of the present application. The disclosure of this referenced application is incorporated fully herein by reference. Light source 10, including the laser-sealed ends of tube 12, are preferably produced in the manner described in U.S. Pat. No. 4,146,380, which issued on Mar. 27, 1979, to the assignee of the present application. The disclosure of this patent is incorporated fully herein by reference.

The side surface of body 11 has a wide base 20 forming a flat front face, a narrow base 21 parallel to base 20, and slanted sides 22 and 23 between bases 20 and 21. A slot 24 formed in body 11 from end to end opens to narrow base 21 to provide an entrance for insertion of light source 10. Slot 24 is dimensioned to receive light source 10 with a snug fit. The entrance of slot 24 opening to narrow base 21 is narrower than the interior portion of slot 24, into which light source 10 actually fits. As a result, overhanging lip portions 25 and 26 are formed along either side of the entrance to slot 24 to retain light source 10 in place in body 11 after its insertion. During insertion of light source 10, the elasticity of body 11 spreads lip portions 25 and 26 apart to permit light source 10 to enter the interior of slot 24 i.e., to snap into place. By way of example, body 11 could be formed by extrusion from a polycarbonate plastic sold under the trademark, LEXAN.

A substantially total reflector 27, which could comprise white or metallic reflective tape, extends around the entire side surface of body 11, except wide base 20; in other words, reflector 27 covers narrow base 21 and slanted sides 22 and 23, as well as the portion of tube 12 exposed by slot 24. Reflector 27 is bonded by an adhesive to body 11 and tube 12 to hold it and light source 10 in place. A partially light-transmissive strip or layer 28 covers a portion of base 20, specifically that portion thereof through which light rays from light source 10 pass normal to the surface of base 20. In other words, the width of layer 28 is equal to that of light source 10. Layer 28 could comprise a thin coating of acrylic lacquer having partially transmissive properties. Generally, layer 28 would transmit approximately 40–50% of the incident light and reflect back toward light source 10 the remaining 50–60%. Base 20 lies adjacent to a back face 30 of liquid crystal display 15, and the figures are displayed on a front face 31 thereof. The figure display region of liquid crystal display 15 coincides in area with base 20.

Light emitted from the wide side face of light source 10 facing away from base 20 and from the narrow side faces of source 10 are reflected from reflector 27 toward base 20. The light emitted from the wide side face of light source 10 facing toward base 20 is transmitted directly thereto. Thus, all the light emitted from light source 10 is transmitted either directly or by reflector 27 toward base 20. Layer 28 serves to change the distribution of the light emitted from light source 10, specifically to distribute this light approximately evenly across the entire width of base 20. Body 11 accordingly serves to spread or diffuse the light from light source 10 out to cover an area, namely, base 20, that is wider than light source 10, it serves as a holder for light source 10, and it provides supporting surfaces for reflector 27 and layer 28.

In a typical embodiment, tube 12 would be 135 mils in width and 32 mils in thickness, base 20 would be 180 mils in width, base 21 would be 121 mils in width, the distance between bases 20 and 21 would be 42 mils, the distance between base 20 and tube 12 would be 7 mils, the distance between base 21 and tube 12 would be 3 mils, the angle between base 20 and sides 22 and 23 would be 35°, the thickness of reflector 27 would be 1 mil, the thickness of layer 28 would be 1 mil, and the width of layer 28 would be 135 mils. Thus, the described lighting system spreads light from a width of 135 mils to a width of 180 mils and does not add appreciable thickness to the assembly, vis a vis, a conventional light pan.

Figure 3:
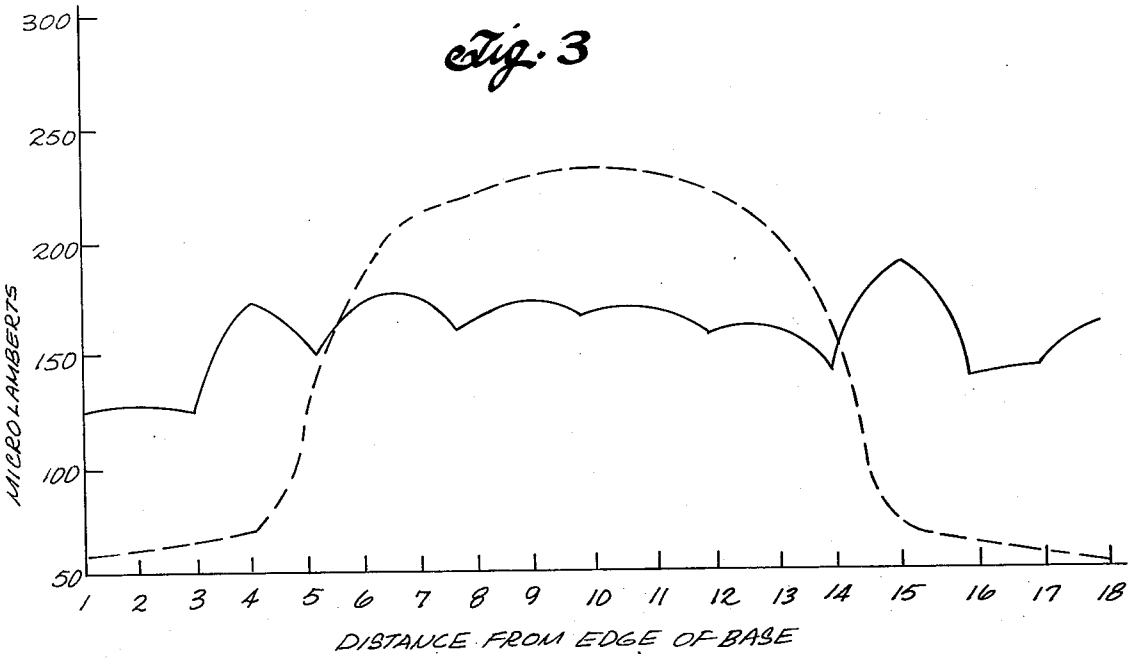
FIG. 3 is a comparative graph of the light emitted from the lighting system of FIG. 1 across its width.

In the graph of FIG. 3, the ordinate represents light emission from base 20 in microlamberts, and the abscissa represents the distance across the width of base 20 from edge to edge in mils. The dashed curve represents a typical distribution of the light emitted from base 20 without layer 28. The light is concentrated in the portion of the surface area of base 20 through which light rays from light source 10 pass normal to base 20. Very little light is emitted from the remainder of base 20, even though slanted sides 22 and 23 reflect light toward base 20. The solid curve represents a typical light distribution across the width of base 20 with layer 28. A much more uniform, approximately even, distribution of light occurs across the width of base 28 from edge to edge; the light emission from the area of base 20 uncovered by layer 28 is substantially increased, and the light emission from the area of base 20 covered by layer 28 is somewhat reduced. The result is a self-luminous lighting system that provides acceptable illumination for backlighting a liquid crystal display having a figure display region coinciding in area with base 20. In other words, the described lighting system spreads out the light illuminate an area that is wider than the light source. This permits fewer or narrower light sources to be used than in the past.

Figure 4:
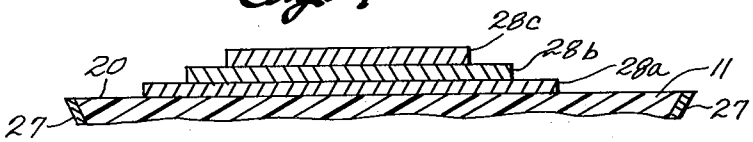
FIG. 4 is an alternative embodiment of a lighting system incorporating the principles of the invention.

In FIG. 4, instead of a single layer 28, base 20 is coated with a plurality of layers 28*a*, 28*b*, and 28*c* of partially transmissive material of differing width. Layers 28*a*, 28*b*, and 28*c* could be formed by separate coats of acrylic lacquer, each put on after the coat beneath it has dried. The thickness, and thus the light transmission, varies across the width of base 20 in a manner to further equalize the light distribution.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, although it is preferable for the light source to have an elongated cross-section, the principles of the invention are applicable to a light source having a circular cross-section. The light-diffusive body could also have other shapes, and the front face thereof could be curved instead of flat.

I claim:

1. A self-luminous lighting system comprising:

an elongated sealed glass tube filled with a radioactive material;

a phosphor in the tube, the phosphor emitting light from the tube responsive to the radioactive material;

an elongated light diffusive body encapsulating the tube, one portion of the side surface of the body forming a front face wider than the tube;

a substantially total reflector extending around the entire side surface of the body except for the front face to reflect the light emitted from the tube toward the front face; and means for changing the distribution of the light emitted from the tube as it leaves the front face.

2. The lighting system of claim 1, in which the changing means distributes the light leaving the front face approximately evenly.

3. The lighting system of claim 1, in which the changing means is a partially light-transmissive coating on the portion of the front face through which light rays from the tube pass normal to the front face.

4. The lighting system of claim 1, in which the front face is flat.

5. The lighting system of claim 1, in which the body has a trapezoidal cross section, a wide base comprising the front face and a narrow base, a first slanted side, and a second slanted side comprising the remainder of the side surface of the body.

6. The lighting system of claim 1, in which the body has a longitudinal slot opening to the narrow base and the tube fits in the slot.

7. The lighting system of claim 1, additionally comprising a liquid crystal display having a front face where figures are displayed and a back face adjacent to the front face of the body, the figure display region of the liquid crystal display coinciding in area with the front face.

8. The lighting system of claim 3 in which the partially light-transmissive coating has a thickness varying in a manner to equalize the light distribution across the width of the front face.

9. The lighting system of claim 3, in which the front face is flat.

10. The lighting system of claim 9, in which the body has a trapezoidal cross section, a wide base comprising the front face and a narrow base, a first slanted side and a second slanted side comprising the remainder of the side surface of the body.

11. The lighting system of claim 10, in which the body has a longitudinal slot opening to the narrow base and the tube fits in the slot.

12. The lighting system of claim 11, additionally comprising a liquid crystal display having a front face where figures are displayed and a back face adjacent to the front face of the body, the figure display region of the liquid crystal display coinciding in area with the front face.

13. A self-luminous lighting system comprising:

an elongated self-luminous light source having two wide side faces and two narrow side faces;

a light-diffusing holder having a trapezoidal cross-section forming a wide base and a narrow base adjacent and approximately parallel to the wide side faces of the light source and slanted sides adjacent to the narrow side faces of the light source;

a longitudinal slot formed in the holder opening to the narrow base, the light source fitting in the slot;

a reflective coating on the slanted sides, the narrow base, and the portion of the light source exposed by the slot, so as to reflect light emitted from the light source toward the wide base; and a strip of partially light-transmissive material on the portion of the base through which light rays from the light source pass normal to the wide base.

14. The lighting system of claim 13 in which the slot has an entrance with overhanging lips spaced apart a distance smaller than the width of the light source to retain the light source in the slot, the material of the holder being sufficiently resilient to permit the lips to spread apart for insertion of the light source into the slot.

15. The lighting system of claim 3, in which the coating transmits approximately 40% to 50% of the incident light rays from the tube passing normal to the front face, reflecting the remainder back toward the tube.

16. The lighting system of claim 13, in which the partially light transmissive material transmits approximately 40% to 50% of the incident light rays from the light source and reflects the remainder thereof back to the light source.

* * * * *